United States Patent [19]

Harase et al.

[11] Patent Number: 4,806,176

[45] Date of Patent: Feb. 21, 1989

[54] PROCESS FOR PRODUCING A GRAIN-ORIENTED ELECTROMAGNETIC STEEL SHEET HAVING A HIGH MAGNETIC FLUX DENSITY

[75] Inventors: Jiro Harase; Katsuro Kuroki; Toshiya Wada; Shozaburo Nakashima, all of Kitakyushu, Japan

[73] Assignee: Nippon Steel Corporation, Otemachi, Japan

[21] Appl. No.: 381,877

[22] Filed: May 25, 1982

[30] Foreign Application Priority Data

May 30, 1981 [JP] Japan ..... 56-83071

[51] Int. Cl.[4] ..... H01E 1/04

[52] U.S. Cl. ..... 148/111; 148/112

[58] Field of Search ..... 148/111, 112, 113

[56] References Cited

U.S. PATENT DOCUMENTS

| | | | |
|---|---|---|---|
| 3,636,579 | 1/1972 | Sakakura et al. | 148/111 |
| 3,933,024 | 1/1976 | Matsumoto et al. | 148/111 |
| 3,959,033 | 5/1976 | Barisoni et al. | 148/111 |
| 4,123,298 | 10/1978 | Kohler et al. | 148/111 |
| 4,319,936 | 3/1982 | Dahlstrom et al. | 148/111 |

FOREIGN PATENT DOCUMENTS

| | | | |
|---|---|---|---|
| 1434213 | 5/1976 | United Kingdom | 148/111 |

*Primary Examiner*—John P. Sheehan

[57] ABSTRACT

The present invention relates to an improvement in the precipitation annealing of a hot-rolled steel sheet or strip which is carried out immediately before cold-rolling in the production of a grain-oriented electromagnetic steel sheet or strip. Conventionally, precipitation annealing is carried out by heating a steel strip to a temperature of from 750° to 1200° C. and then quenching it. The present invention proposes to control the cooling rate during primary cooling, i.e. from a holding temperature ($T_1$ temperature) of from 1080° to 1200° C. down to an intermediate temperature ($T_2$ temperature) of from 900° to 980° C., and to control the staying time during primary cooling so that excellent magnetic properties can be obtained regardless of the unavoidable variation in the Al and Si content. The present invention also proposes to control the rate of temperature elevation between 800° C. and the holding temperature as to obtain AlN particles having an optimum size.

7 Claims, 3 Drawing Sheets

(——)NaSAlN (ppm)
70
60
40
20
(----)AVERAGE SIZE OF PRECIPITATED AlN (Å)
200
150
100
50
Si3N4 (ppm)
80
40
0
700°C
800°C
900°C
1000°C
1150°C
TEMPERATURE IN THE PROCESS OF TEMPERATURE-ELEVATING
HOT-ROLLED STRIP (BEFORE PRECIPITATION-ANNEALING)

PROCESS FOR PRODUCING A GRAIN-ORIENTED ELECTROMAGNETIC STEEL SHEET HAVING A HIGH MAGNETIC FLUX DENSITY

The present invention relates to a process for producing a grain-oriented electromagnetic steel sheet or strip having a high magnetic flux density.

Since a grain-oriented electromagnetic steel sheet is used as soft magnetic material and is mainly used as the core material of transformers and various electrical machinery and apparatuses, its magnetic properties therefore must be a good exciting characteristic and a low watt loss. Usually, the exciting characteristic mentioned above is numerically expressed by a $B_8$ value, that is, the magnetic flux density at a magnetization force of 800 A/m, while the watt loss is numerically expressed by a $W_{17/50}$ value (W/kg), that is, the watt loss per kilogram of a grain-oriented electromagnetic steel sheet under a magnetic flux density of 1.7 Tesla (T) of the alternating magnetic flux having a frequency of 50 Hz.

A grain-oriented electromagnetic steel sheet can be obtained by developing a so-called Goss texture or a (110) <001> orientation usually by means of a secondary recrystallization phenomenon. The designation of (110) <001> indicates that the (110) plane of the crystal grains of a steel is parallel to the surface of a grain-oriented electromagnetic steel sheet while the <001> axis of the crystal grains is oriented in the rolling direction of such sheet. In order to produce a grain-oriented electromagnetic steel sheet or strip having good magnetic properties, not only is orienting the <001> axis to a high degree in the rolling direction important but also it is important to control the production conditions of the steel sheet or strip so that the steel sheet or strip has an appropriate grain size, purity, and resistivity. Several steps, especially appropriate rolling and annealing steps, for producing a grain-oriented electromagnetic steel sheet or strip are combined so as to orient the secondary recrystallized grains to a high degree. In order for the phenomenon of secondary recrystallization to occur stably and in order to achieve a high degree of orientation, it is critical that precipitates having an appropriate dimension be present in the steel sheet or strip in a uniformly dispersed state and in a certain quantity.

The precipitates mentioned above are referred to as the inhibitors, and the inhibitors which are industrially used at present include MnS, AlN, MnSe, and BN.

The precipitates, which can act as inhibitors, usually have a dimension in the range of from 100 Å (10 Nm) to 1000 Å (100 Nm) and are very fine particles. So that these very fine precipitates can be formed in a steel sheet or strip in a uniformly dispersed state, each step in the production of a grain-oriented electromagnetic steel sheet or strip must be strictly controlled. Obviously, the steel chemistry is controlled in the steelmaking step, as are the hot-rolling conditions and precipitation.

Japanese Published Patent Application No. 46-23820 (U.S. Pat. No. 3,636,579) proposes subjecting a steel sheet or strip containing a small amount of carbon and aluminum to one type of precipitation annealing. This type of precipitation annealing is characterized by carrying out annealing for a period of from 30 seconds to 30 minutes at a temperature ranging from 750° to 1200° C. depending upon the silicon content, and subsequently quenching the steel sheet or strip from a temperature ranging from 750° to 950° C., depending upon the carbon and silicon content. In the case of silicon steels subjected to the type of precipitation annealing proposed in Japanese Published Patent Application No. 46-23820, AlN and MnS are precipitated, and MnS is mainly precipitated in the hot-rolling step. In addition, since precipitation annealing determines the size and amount of the precipitated AlN and MnS, it greatly influences the magnetic properties of the final product.

So that a Goss texture having a high orientation can be achieved, it is important to maintain the size of the precipitates, particularly those composed of AlN, at a value less than a certain critical value, and precipitates which are coarsened beyond the certain critical value cannot act as inhibitors. The particle diameter of the inhibitors varies in accordance with the rate of temperature elevation, the holding temperature, and the holding time of precipitation annealing and is largely influenced by the components of silicon steels, particularly the aluminum content. The aluminum content of industrially produced silicon steels cannot be controlled so that it is one specific value but varies within a certain range which is allowable in the light of the standards for the magnetic properties. Precipitation annealing carried out taking into consideration the varying aluminum content is desirable but unrealistic. Therefore, the conditions under which precipitation annealing is carried out should be determined based on the average aluminum content, with the result that the magnetic properties of the final product whose aluminum content deviates from the average aluminum content are not excellent but vary around average values. The silicon content, which is one of the basic components of a grain-oriented electromagnetic steel sheet or strip, exerts a great influence on not only the metal structure of silicon steels but also on the precipitation behavior of AlN or the like. The unavoidable variation in the silicon content therefore makes it impossible to obtain excellent magnetic properties regarding the final product. Therefore, it is important to carry out inhibitor precipitation, in which the influence of the basic components of silicon steels on such precipitation is lessened.

It is an object of the present invention to provide a process for producing a grain-oriented electromagnetic steel sheet in which precipitation annealing can be carried out, immediately before cold rolling is initiated, in an annealing pattern capable of lessening the influence of the components of the silicon steels, particularly the aluminum and silicon content, the optimum annealing condition, thereby enabling a final product having excellent magnetic properties to be obtained.

The concept of precipitation annealing according to the present invention involves cooling from the holding temperature to an intermediate temperature at a controlled rate, thereby forming precipitates during controlled cooling and satisfactorily increasing the amount of precipitates so as to obtain excellent magnetic properties regardless of a variation in the components of the silicon steels; and quenching from the intermediate temperature to room temperature.

In the process according to the present invention, silicon steels produced by means of known steelmaking, melting and casting processes are subjected steps in which secondary recrystallized crystal grains having a {110}<001> orientation are generated. These steps are a hot-rolling, at least one annealing, at least one cold-rolling step for obtaining a final thickness, followed by decurburization annealing and final annealing.

The present invention, in which the concept of precipitation annealing mentioned above is embodied, is characterized by realizing a holding temperature ranging from 1080° to 1200° C. for less than 60 seconds (including zero second); controlling the rate of cooling of the steel from the holding temperature to an intermediate temperature of from 900° to 980° C., preferably from 900° to 950° C., in such a manner that satisfactory precipitation occurs during cooling; and quenching the steel to room temperature from a temperature ranging from 900° to 980° C. (the intermediate temperature) at a cooling rate of at least 10° C./sec When the holding temperature is lower than 1080° C., precipitation annealing is not effective for obtaining a final product having excellent magnetic properties. On the other hand, when the holding temperature is higher than 1200° C., the size of the precipitates is liable to vary or to be coarsened. In addition, a holding temperature higher than 1200° C. is not advisable in the light of the metal structure of an annealed sheet or strip.

The holding time of less than 60 seconds (including zero second) is determined taking into consideration of the size of precipitates and the metal structure. A specific value of the holding time shorter than 60 seconds is determined depending upon the rate of temperature elevation, the holding temperature, the rate of cooling and the silicon content. When the silicon content exceeds 3%, the holding time should be short and can be zero second occasionally, since high silicon contents tends to promote the coarsening of grains on the surface of an annealed sheet or strip.

Cooling of the steel from the holding temperature to an intermediate temperature of from 900° to 980° C., hereinafter referred to as primary cooling, will now be explained. The staying time is the time period from the completion of annealing at the holding temperature until just before quenching is begun, i.e., the time period when, the steel sheet or strip is subjected to primary cooling is from 20 seconds to 500 seconds. In a case where a steel sheet or strip is maintained at an intermediate temperature of from 900° to 980° C. before quenching, the time the sheet or strip is maintained at this temperature is part of the staying time mentioned above. The present inventors discovered that a staying time of from 20 to 500 seconds at primary cooling in the specified temperature range can stabilize, regardless of a variation in the components of silicon steels, secondary recrystallization by controlling the amount of precipitates formed during primary cooling. The longer the staying time is, the more stable secondary recrystallization is, and said amount of precipitates is increased. However, a staying time of more than 300 seconds does not appreciably contribute to enhancement of the magnetic properties of the final product, and also such a long staying time is not advisable from an industrial point of view. On the other hand, when the staying time is less than 20 seconds, the amount of precipitates is too small to stabilize secondary recrystallization regardless of a variation in the components of the silicon steels. Thus, a final product having excellent magnetic properties cannot be obtained.

In primary cooling, any cooling rate or any cooling pattern may be used provided that the staying time specified above is realized. For example, the cooling rate may be inconstant and cooling may be interrupted. A satisfactory amount of precipitates can be formed by prolonging primary cooling from 60 seconds to less than 250 seconds so that maintaining the steel sheet or strip at a temperature of from 900° to 980° C. is not necessary.

Silicon steels containing a large amount of aluminum, for example, from 0.035 to 0.050%, should be rapidly cooled within a high temperature range during primary cooling so as to shorten the staying time of the steel sheet or strip in a high-temperature furnace and thus prevent coarsening of the precipitates composed of AlN. In addition, when the silicon content is high, for example from 3.2 to 4.0%, the staying time of a steel sheet or strip in a furnace should be shortened so as to prevent coarsening of the crystal grains on the surface of the annealed sheet or strip. In this case, the temperature should be rapidly lowered to an intermediate temperature of from 900° to 980° C. in a short time, for example, from 10 to less than 60 seconds. It is, however, necessary to maintain the steel sheet or strip at an intermediate temperature of from 900° to 980° C. for a period of from 10 to 450 seconds in order to realize the specified staying time and thereby form a satisfactory amount of precipitates. Quenching from an intermediate temperature of from 900° to 980° C. is hereinafter referred to as secondary cooling.

BRIEF DESCRIPTION OF THE DRAWINGS

The present invention is explained more in detail with reference to the drawings, wherein.

Figures 2A, 2B:
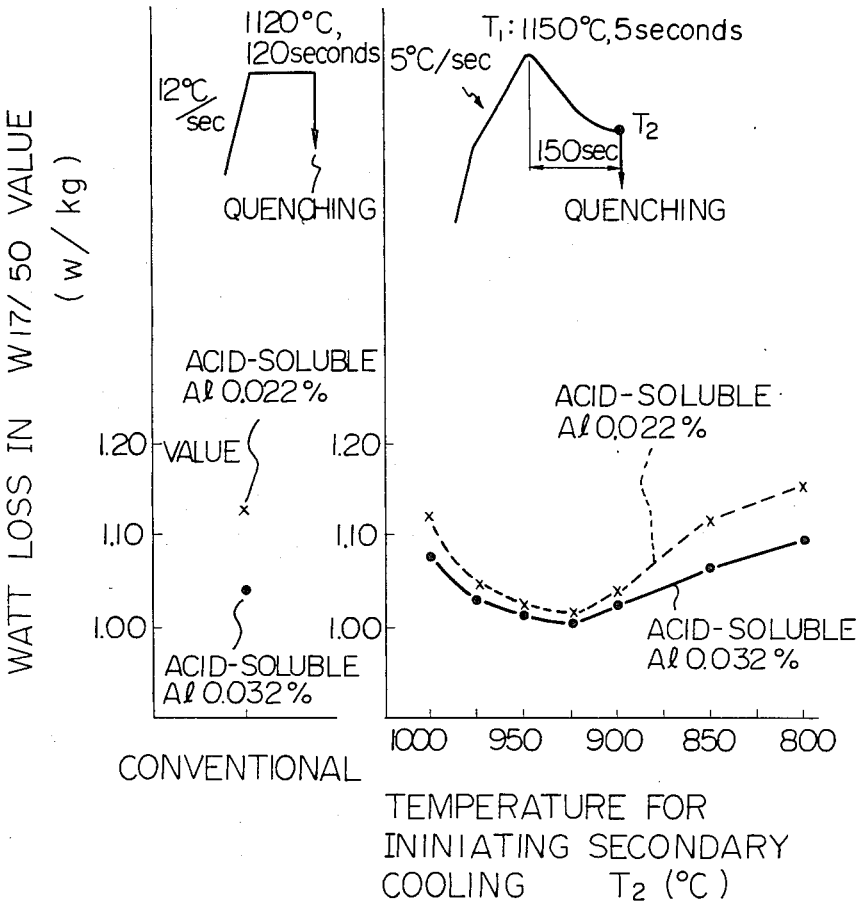
FIGS. 2A and 2B illustrate two precipitation annealing heat cycles and the resultant watt loss values.
Figure 3A:
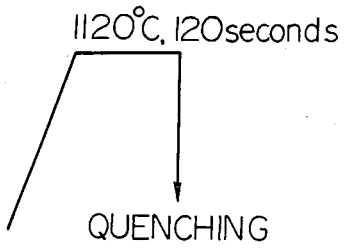
FIGS. 3A and 3B illustrate the precipitation annealing heat cycles employed in Example 1.
Figure 3B:
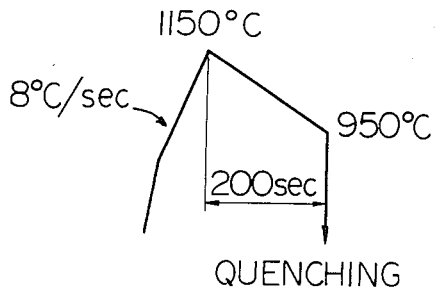

As shown in the graph (right) of FIG. 2, in an experiment performed by the inventors, the $T_1$ temperature in the involving heat cycle of precipitation annealing was 1150° C. In the graph, $T_1$ indicates the holding temperature and $T_2$ indicates the temperature for initiating secondary cooling. The dependence of the watt loss ($W_{17/50}$ value) upon the $T_2$ temperature is also indicated, as are the patterns of the silicon steels subjected to precipitation annealing and containing either 0.022% acid-soluble aluminum or 0.032% acid-soluble aluminum. As is apparent from the graph, the watt loss $W_{17/50}$ value) was the lowest when the $T_2$ temperature was approximately 925° C. In addition, the watt loss ($W_{17/50}$ value) was very low at a $T_2$ temperature of from 900° to 980° C. The heat cycle of conventional precipitation annealing and the watt loss are illustrated in the graph shown in the left part of FIG. 2. The silicon steels subjected to conventional precipitation annealing and those subjected to the precipitation annealing of the present invention contained 2.95% Si, 0.055% C, 0.075% Mn, 0.025% S, 0.0075% N and either 0.022% acid-soluble Al or 0.032% acid-soluble Al, the remainder being iron. In the present invention, precipitation annealing can be carried out in any gas atmosphere as long as excesive decarburization of the annealed sheet or strip does not result, and secondary cooling is carried out by means of forced cooling, such as water cooling.

In an embodiment of the present invention, the rate of temperature elevation up to the holding temperature is controlled, thereby lessening the change in the size of the precipitates. The rate of temperature elevation from a temperature of 800° C. to the holding temperature is controlled within the range of from 2° to 10° C./second for the following reasons. The size of the AlN particles precipitated in silicon steels is increased at a high precipitation annealing temperature and is further increased at a high precipitation annealing temperature when the aluminum content of the silicon steels is high. The present inventors discovered that among the factors causing the particle diameter of the precipitates to vary, i.e., the rate of temperature elevation, the holding temperature, and the holding time, the rate of temperature elevation is the dominant factor. The size of the AlN particles precipitated in silicon steels during the temperature elevating stage of precipitation annealing, hereinafter simply referred to as the size of the precipitated AlN particles, is sharply increased when the temperature is elevated to higher than 800° C., and therefore it is necessary to control the rate of temperature elevation between 800° C. and the holding temperature, thereby decreasing the size of the precipitated AlN particles as much as possible.

The present inventors also discovered that slow heating of a steel sheet or strip within said temperature range does not result in an appreciable change in the size of the precipitated AlN particles, the size not being changed substantially even if the aluminum content of the sheet or strip is high. On the other hand, rapid heating of a steel sheet or strip within said temperature range results in a change in the size of the precipitated AlN particles or in coarsening of the precipitated AlN particles, which change or coarsening is enhanced if the aluminum content of the sheet or strip is high.

In a preferred embodiment of the present invention, the rate of temperature elevation from a temperature of 800° C. to the holding temperature is from 4° to 7° C./second, the holding temperature ($T_1$ temperature) is from 1120° to 1170° C., the holding time is less than 30 seconds, the staying time is from 60 to 250 seconds, and the temperature for initiating quenching ($T_2$ temperature) is from 920° to 950° C.

Figures 1A, 1B:
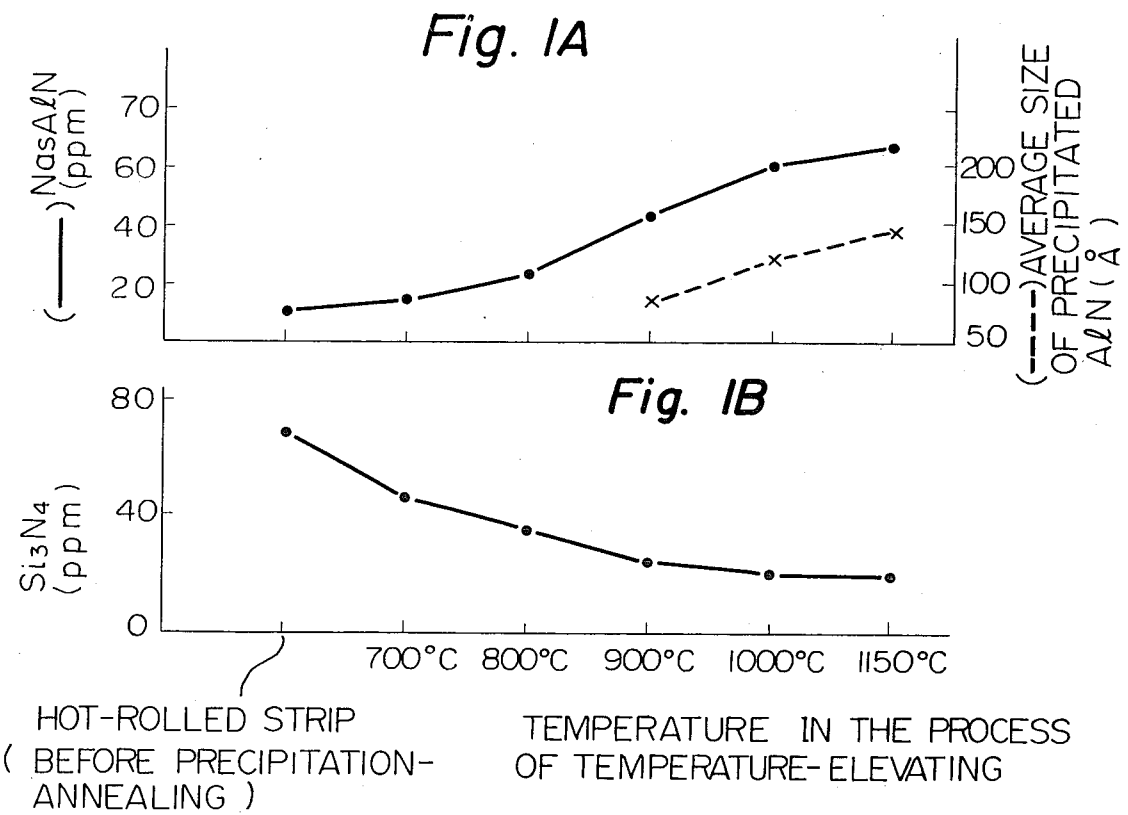
FIGS. 1A and 1B show two graphs illustrating the decomposition of $Si_3N_4$ and the precipitation of AlN during elevation of the temperature of a steel sheet or strip containing 2.95% Si and 0.028% acid-soluble Al.

Referring to FIG. 1, sections of a hot-rolled silicon steel strip containing 2.95% Si and 0.028% Al were heated to a holding temperature of 1150° C. at a rate of temperature elevation of 5° C./sec. The nitrogen, which combined with the aluminum to form AlN, and the $Si_3N_4$ were quantitatively analyzed both before precipitation annealing was carried out and after heating of the steel strip to a temperature of 700° C., 800° C., 900° C., 1100° C. and 1150° C., respectively was carried out. The fact that the $Si_3N_4$ decreased with an increase in temperature indicates that the $Si_3N_4$ decomposed in the hot-rolled silicon steel strip while the temperature was elevated. And the fact that the nitrogen which combined with the aluminum to form AlN increased with an increase in temperature indicates that AlN particles were precipitated in the hot-rolled silicon steel strip during elevation of the temperature. The sharp increase in the nitrogen, which combined with the aluminum to form AlN, at a temperature of 800° C. or higher indicates that 800° C. is the minimum temperature at which vigorous precipitation of AlN occurs. FIG. 1 also shows that the $Si_3N_4$ precipitated in the hot-rolled silicon steel strip decomposed to give free nitrogen, which in turn combined with aluminum to form AlN. FIG. 1 also shows a result of measurement of the average size of precipitated AlN which were extracted by a C-replica method and then observed by an electron microscope. Since the vigorous precipitation of AlN involves increasing the amount and size of the precipitated AlN particles, the rate of elevation of the temperature from 800° C. to the holding temperature should be so slow that the optimum size of the precipitated AlN particles is realized. In addition to considering the size of the precipitated AlN particles, the following should also be considered when determining the rate of temperature elevation in the range of from 2° C./sec to 10° C./sec. When the rate of temperature elevation is less than 2° C./sec, the staying time of a steel sheet or strip in a high-temperature zone of a furnace is so prolonged that the metal structure on the surface of an annealed sheet or strip is disadvantageously changed due to grain growth. On the other hand, when the rate of temperature elevation is more than 10° C./sec, the components of the silicon steels are liable to exert an influence on the optimum precipitation annealing conditions, thus increasing the possibility of unstable secondary recrystallization.

The slow rate of temperature elevation, i.e. from 2° C./sec to 10° C./sec, at a temperature ranging from 800° C. to the holding temperature according to the present invention should be specifically used when the aluminum content is high, for example from 0.021 to 0.050%. In other words, when the aluminum content is high, the slow heating of a steel sheet or strip should be carried out so as to carefully provide an optimum condition for finely precipitating AlN. On the other hand, when the aluminum content is low, for example from 0.010 to 0.020, such careful provision may not be necessary. Therefore, rapid heating of a steel sheet or strip may be carried out in precipitation annealing.

In an embodiment of the present invention, wherein rapid heating of a steel sheet or strip is carried out, the temperature is maintained at from 750° to 1000° C. for a period of from 20 to 200 seconds and then is elevated to a holding temperature of from 1080° to 1200° C. Holding the temperature at from 750° to 1000° C., is effective for optimum precipitation of AlN during elevation of the temperature up to the holding temperature. Precipitation of AlN appreciably occurs at the minimum intermediate temperature of 750° C., depending upon the holding time at such temperature. On the other hand, when the temperature is higher than 1000° C., holding the temperature at said temperature tends to deteriorate the metal structure of an annealed sheet or strip. The holding time at a temperature of from 750° to 1000° C. should be adjusted depending upon such temperature. A holding time of less than 20 seconds is insufficient to bring about satisfactory precipitation of AlN even if the selected temperature is high. Satisfactory precipitation of AlN can be attained at a holding time of 200 seconds even if the temperature is low. A holding time of more than 30 seconds to bring about effective precipitation of AlN is not advisable.

In order to form a Goss texture, silicon steels must contain the following components at the content specified hereinafter. The silicon content of silicon steels must be from 2.5 to 4.0%. When the silicon content is more than 4.0%, theccold-rolling of silicon steels is difficult, and when the silicon content is less than 2.5%, the resistivity of silicon steels is too low for a good watt loss to be expected.

Silicon steels contain carbon, as every steel does, but the minimum carbon content is specifically adjusted, taking the silicon content into consideration, so that the silicon steels are partially transformed to a gamma phase. When the carbon content exceeds 0.085%, not only is it impossible to obtain a final product having a high magnetic flux density but also silicon steels cannot be decarburized satisfactorily by means of decarburization annealing.

Aluminum is a main element which contributes to enhancing the magnetic flux density of the final product. An aluminum content of from 0.010 to 0.050% is determined as being sufficient to stabilize secondary recrystallization and hence to obtain a final product having a high magnetic flux density.

Manganese is a necessary element in the formation of MnS and an appropriate manganese content is from 0.03 to 0.15%. When the sulfur content exceeds 0.050%, the desulfurization of silicon steels during purification annealing is insufficient for obtaining a final product having excellent magnetic properties. When the sulfur content is less than 0.010%, the amount of MnS is small.

Silicon steels which are subjected to the method of the present invention may additionally contain at least one known element capable of either acting as an inhibitor in an element form or capable of forming compounds which behave as inhibitors. This element includes copper (Cu), antimony (Sb), tin (Sn), chromium (Cr), nickel (Ni), molybdenum (Mo) and vanadium (V). The content of these elements is preferably low and should not exceed 0.3% in total in the case of copper, tin, chromium, nickel, molybdenum and vanadium. When the content exceeds 0.3%, the magnetic properties of the final product deteriorate and the operating efficiency of silicon steels is decreased in the hot-rolling, pickling, and decarburizing-annealing steps since copper and the like render silicon steels less workable during the hot-rolling step, the scales of an annealed sheet less removable, and the carbon in silicon steels less decarburizable. In the case of antimony, a content higher than 0.1% renders the carbon of silicon steels less decarburizable.

Silicon steels containing the above-mentioned elements are produced by means of a known steelmaking or melting process and a casting process. A process of the present invention involves subjecting an ingot or slab of the silicon steels mentioned above to hot-rolling by means of a known method, thereby obtaining a hot-rolled strip or sheet. This process comprises cold-rolling of the ingot or slab. Cold-rolling is carried out in one step or two steps. The final cold-rolling step, that is cold-rolling carrie out immediately after precipitation annealing, must be heavy cold-rolling at a reduction of from 81 to 95%. The cold-rolling may be conventional cold-rolling, that is, cold-rolling in which heat is not intentionally applied to a steel strip. However, heat is advantageously applied to a steel strip at each pass of cold-rolling so that a temperature of from approximately 100° to 300° C. is attained between every cold-rolling stands. In the case of cold-rolling carried out in two steps, the reduction at the first cold-rolling is 30% or less and the reduction at the second cold-rolling is from 81 to 95%.

A cold-rolled steel strip having a final thickness is then subjected to decarburization annealing by means of a known method so as to remove the carbon from the cold-rolled steel strip and also to develop a primary recrystallized structure. Then an annealing separator mainly composed of MgO is applied to the surface of the cold-rolled steel strip and final annealing is carried out so as to develop secondary recrystallized grains having a {110}<001> orientation and to simultaneously purify the cold-rolled steel strip. Final annealing may be carried out at, for example, 1200° C. for 5 hours or longer. The controlled atmosphere in final annealing is not specifically limited but is preferably a reducing gas.

The present invention is now explained by way of examples.

EXAMPLE 1

A silicon steel slab A containing 2.93% Si, 0.052% C, 0.074% Mn, 0.024% S, 0.030% acid-soluble Al, and 0.073% N and a silicon steel slab B having virtually the same composition as that of the silicon steel slab A, except that the acid-soluble Al content was 0.022%, were heated to 1350° C. and held at this temperature for one hour, followed by hot-rolling to obtain 2.3 mm-thick hot-rolled strips. These hot-rolled strips were precipitation annealed under the conditions given in Table 1 below, were pickled, and then were cold-rolled so as to reduce their thickness to 0.30 mm. While the hot-rolled and then precipitation annealed strips were being cold-rolled, they were simultaneously subjected to a heat treatment (at 200° C. for 5 minutes) in which heat was applied to the strips between every cold-rolling stands. The cold-rolled steel strips were decarburization annealed at 850° C. for 2 hours in a controlled atmosphere composed of 75% $H_2$ and 25% $N_2$ and having a dew point of −60° C. After an annealing separator mainly composed of MgO and 5% $TiO_2$ was applied to the decarburized steel strips, the strips were subjected to final annealing at 1200° C. for 20 hours.

The "Conventional Method" indicated in Table 1 is conventional precipitation annealing in which holding of the temperature was carried out at 1120° C. for 2 minutes, the rate of elevation of the temperature to the holding temperature was 12° C./sec, and cooling from the holding temperature was by quenching. This pattern of precipitation annealing is diagramatically shown in the left part of FIG. 2. The "Invention" indicated in Table 1 indicates precipitation annealing according to the present invention in which holding of the temperature was carried out at 1150° C. for 5 seconds, the rate of elevation of the temperature was from 800° C. to 1150° C. ($T_1$-temperature) was 8° C./second, the time period for cooling from 1150° C. to 950° C. (primary cooling) was 200 seconds, and cooling from 950° C. to room temperature (secondary cooling) was by quenching.

The $B_8$ value and $W_{17/50}$ value of the final products are given in Table 1.

TABLE 1

| | Conventional Method | | Invention | |
|---|---|---|---|---|
| | $B_8$ (T) | $W_{17/50}$ (w/kg) | $B_8$ (T) | $W_{17/50}$ (w/kg) |
| Si steel Slab A | 1.93 | 1.04 | 1.94 | 1.00 |
| Si steel Slab B | 1.89 | 1.15 | 1.93 | 1.03 |

EXAMPLE 2

The silicon steel contained 3.10% Si, 0.062% C, 0.074% Mn, 0.023% S, 0.025% acid-soluble Al, and 0.0075% N, the remainder being essentially iron. Hot-rolled strips of said silicon steel were precipitation annealed under the following conditions:

Condition A

A hot-rolled strip was heated to 1170° C. while the temperature was elevated from 800° C. to 1170° C. at a rate of 5° C./second, and cooling was carried out upon completion of temperature elevation. Primary cooling from 1170° C. to 930° C. was carried out for 200 seconds and secondary cooling from 930° C. was carried out using hot water (100° C.).

Condition B

A hot-rolled strip was subjected to the same type of precipitation annealing as in Condition A except that primary cooling was carried out for 15 seconds and a staying time of 195 seconds was achieved by holding or interrupting cooling at 930° C. (intermediate temperature) for 180 seconds.

Condition C (Comparative Condition)

A hot-rolled strip was subjected to the same type of precipitation annealing as in Condition A except that primary cooling was carried out for only 15 seconds. The staying time was therefore only 15 seconds.

The precipitation annealed hot-rolled strips were pickled and cold-rolled so as to produce 0.3 mm-thick cold-rolled steel strips. While the hot-rolled and then precipitation-annealed strips were being cold-rolled, heat was simultaneously applied to the strips between every cold-rolling stands, with the result that a heat treatment of strips having a predetermined thickness at a temperature of 200° C. for 5 minutes was attained. The cold-rolled strips were subjected to decarburization annealing and final annealing, and the $B_8$ value and the $W_{17/50}$ value of the final products are given in Table 2.

TABLE 2

| | Precipitation-Annealing Conditions | | |
|---|---|---|---|
| | A | B | C |
| $B_8$ (T) | 1.94 | 1.94 | 1.91 |
| $W_{17/50}$ (w/kg) | 0.98 | 0.97 | 1.09 |

The $B_8$- and $W_{17/50}$-values of final products obtained when a hot-rolled strip was precipitation annealed under Condition A were virtually the same as those when a hot-rolled strip was precipitation annealed under Condition B. Both the $B_8$ value and $W_{17/50}$ value in the case of Condition C were inferior to those of Conditions A and B.

EXAMPLE 3

A silicon steel containing 3.20% Si, 0.055% C, 0.093% Mn, 0.21% Ni, 0.08% Cu, 0.026% acid-soluble Al, and 0.0078% N, the remainder being essentially iron, was hot-rolled to obtain a 2.3 mm-thick hot-rolled strip of silicon steel. The strip was heated to 1120° C. at a rate of temperature elevation of 8° C./second. The temperature was held at 1120° C. for 30 seconds and then the strip was cooled to 950° C. for 15 seconds (primary cooling). The temperature was then held at 950° C. for 180 seconds and, finally, water cooling from 950° C. was carried out (secondary cooling). The hot-rolled and then precipitation-annealed strip was pickled and then cold-rolled so as to reduce its thickness to 0.30 mm. While the strip was being cold-rolled, heat was applied to said strip, with the result that a heat treatment at 200° C. for 5 minutes was attained. Then the cold-rolled steel strip was subjected to decarburization annealing and final annealing. The $B_8$ value and $W_{17/50}$ value of the final product were as follows:

$B_8$ value: 1.94 T $W_{17/50}$ value: 0.97 w/kg

In order to make a comparison, the above-described procedure was repeated except that holding the temperature at 950° C. was not carried out. Hence, immediately after cooling of the steel strip to 950° C. was carried out, water cooling was carried out. The $B_8$ value and $W_{7/50}$ value of the final producture as follows and were inferior to the above-mentioned respective values attained by means of the present invention:

$B_8$ value: 1.92 T $W_{17/50}$ value: 1.06 w/kg

EXAMPLE 4

Silicon steel containing 3.05% Si, 0.056% C, 0.075% Mn, 0.023% S, 0.029% acid-soluble Al, and 0.0085% N, the remainder being essentially iron, was hot-rolled and then silicon steel strips were precipitation annealed under the following conditions:

Condition A

A hot-rolled strip was heated to 1150° C. while the temperature was elevated from 800° C. to 1150° C. at a rate of approximately 18° C./second and held at 1150° C. for 30 seconds. Then cooling was carried out. Primary cooling from 1170° C. to 900° C. was carried out for 100 seconds and immediately afterward secondary cooling 90° C. was carried out by using water.

Condition B

A hot-rolled strip was heated to 900° C. The rate of temperature elevation was approximately 20° C./second when the temperature was elevated from room temperature to 900° C. The temperature was held at 900° C. for 120 seconds and then was rapidly elevated to 1150° C. and held at 1150° C. for 100 seconds. Cooling from 1150° C. to 900° C. (primary cooling) was then carried out for 30 seconds. After a staying time of 30 seconds, water cooling was immediately carried out (secondary cooling).

The precipitation-annealed hot-rolled strips were pickled and cold-rolled so as to produce 0.3 mm-thick cold-rolled steel strips. While the hot-rolled and then precipitation-annealed strips were being cold-rolled, heat was simultaneously applied to the strips between every cold-rolling stands, with the result that a heat treatment at 250° C. for 5 minutes was attained. Then the cold-rolled strips were subjected to decarburization annealing and final The $B_8$ value and the $W_{17/50}$ value of the final products are given in Table 3.

TABLE 3

| | Precipitation-Annealing Conditions | |
|---|---|---|
| | A | B |
| $B_8$ (T) | 1.91 | 1.94 |
| $W_{17/50}$ (w/kg) | 1.10 | 0.99 |

We claim:

1. A process for producing a grain-oriented electromagnetic steel sheet or strip, wherien a silicon steel ingot or slab containing from 2.5 to 4.0% silicon, not more than 0.085% carbon, from 0.010 to 0.050% acid-soluble aluminum, from 0.03 to 0.15% manganese, and from 0.010 to 0.050% sulfur is successively hot-rolled, precipitation-annealed, reduced by cold-rolling at least once, decarburized, and subjected to final annealing, said reduction by said cold-rolling step being carried out so as to obtain a final thickness by reducing the thickness from 81 to 95%, characterized in that said precipitation annealing is carried out by first appreciably precipitating AlN by elevating the temperature to a holding temperature wherein during said elevating the rate of temperature wherein during said elevating the rate of temperature elevation from a temperature of 800° C. to said holding temperature is controlled within the range of from 2° to 10° C./second, by, second holding the temperature at said holding temperature ranging from 1080° to 1200° C. for less than 60 seconds, then carrying out cooling from said holding temperature in such a manner that the staying time during the cooling from said holding temperature to an intermediate temperature of from 900° to 980° C. ranges from 20 seconds to less than 500 seconds, and finally carrying out quenching form said intermediate temperature to room temperature at a cooling rate of at least 10° C./sec.

2. A process according to claim 1, characterized in that the content of acid-soluble aluminum is from 0.021 to 0.050%.

3. A process according to claim 1, characterized in that, the rate of temperature elevation from a temperature of 800° C. to said holding temperature is from 4° to 7° C./second, said holding temperature is from 1120° to 1170° C., the holding time is less than 30 seconds, said staying time is from 60 to 250 seconds, and the temperature for intiating said quenching is from 920° to 950° C.

4. A process for producing a grain-oriented electromagnetic steel sheet or strip, wherein a silicon steel ingot or slab containing from 2.5% to 4.0% silicon, not more than 0.085% carbon, from 0.010% to 0.050% acid-soluble aluminum, from 0.03% to 0.15% manganese, and from 0.010% to 0.050% sulfur is successively hot-rolled, precipitation-annealed, reduced by cold-rolling at least once, decarburized and subjected to final annealing, said reduction by said cold-rolling step being carried out so as to obtain a final thickness by reducing the thickness from 81% to 95%, characterized in that said precipitation annealing is carried out by, first, appreciably precipitating AlN by elevating the temperature up to an intermediate temperature ranging from 750° C. to 1000° C., maintaining the temperature at said intermediate temperature for a period of from 20 to 200 seconds, then elevating the temperature to a holding temperature ranging from 1080° C. to 1200° C., holding the temperature at said holding temperature for less than 60 seconds, then carrying out cooling from said holding temperature in such a manner that the staying time during the cooling from said holding temperature to an intermediate temperature of from 900° C. to 980° C. ranges from 20 seconds to less than 500 seconds, and finally carrying out quenching from said intermediate temperature to room temperature at a cooling rate of at least 10° C./sec.

5. A process according to claim 4, characterized in that the content of acid-soluble aluminum is form 0.021 to 0.050%.

6. A process according to claim 1 or 4, characterized in that immediately after cooling from said holding temperature to said intermediate temperature said quenching is carried out and said staying time during said cooling is from 60 seconds to less than 250 seconds.

7. A process according to claim 1 or 4, characterized in that said cooling from the holding temperature to the intermediate temperature lasts from 10 seconds to less than 60 seconds and then the temperature is maintained at said intermediate temperature for 10 to 450 seconds.

* * * * *

UNITED STATES PATENT AND TRADEMARK OFFICE

CERTIFICATE OF CORRECTION

PATENT NO. : 4,806,176

DATED : February 21, 1989

INVENTOR(S) : J. HARASE et al.

It is certified that error appears in the above-identified patent and that said Letters Patent is hereby corrected as shown below:

Col. 10, line 64:
In claim 1, line 2, delete "wherien" and insert -- wherein --.
Col. 11, lines 8-9:
In claim 1, lines 15-16, delete "wherein during said elevating the rate of temperature".
Col. 11, line 20:
In claim 1, line 26, delete "form" and insert -- from --.
Col. 11, line 31:
In claim 3, line 7, delete "intiating" and insert -- initiating --.
Col. 12, line 24:
In claim 5, line 2, delete "form" and insert -- from --.

Signed and Sealed this

Twenty-fifth Day of June, 1991

*Attest:*

*Attesting Officer*

HARRY F. MANBECK, JR.

*Commissioner of Patents and Trademarks*